United States Patent [19]

Kao

[11] 4,356,380

[45] Oct. 26, 1982

[54] ELECTRIC CIGARETTE LIGHTER

[76] Inventor: Charles T. Kao, 465 Stillmeadow, Richardson, Tex. 75081

[21] Appl. No.: 215,617

[22] Filed: Dec. 12, 1980

[51] Int. Cl.[3] ..... F23Q 7/20

[52] U.S. Cl. ..... 219/262; 219/261; 219/267

[58] Field of Search ..... 219/260, 261, 262, 263, 219/264, 265, 266, 267, 268, 269, 270

[56] References Cited

U.S. PATENT DOCUMENTS

| | | | |
|---|---|---|---|
| 1,844,206 | 2/1932 | Copeland | 219/263 X |
| 1,959,093 | 5/1934 | Davis | 219/261 |
| 1,983,738 | 12/1934 | Davis | 219/262 X |
| 2,554,743 | 5/1951 | Jones | 219/270 |
| 2,558,441 | 6/1951 | Jones | 219/267 X |
| 2,635,171 | 4/1953 | Jones | 219/262 |
| 2,701,836 | 2/1955 | Powenick | 219/262 |
| 2,773,164 | 12/1956 | Busbin | 219/266 |
| 3,379,856 | 4/1968 | Hirsch | 219/268 |
| 3,471,679 | 10/1969 | Ohnborn | 219/269 |
| 3,708,180 | 1/1973 | Bird | 219/263 |

*Primary Examiner*—Volodymyr Y. Mayewsky

*Attorney, Agent, or Firm*—Dennis T. Griggs

[57] ABSTRACT

A cigarette lighter which uses household current features automatic operation by manipulation of the cigarette only. The cigarette lighter includes a housing having an ashtray portion and an upper housing portion having a passage defining a chimney overlying the ashtray. A cigarette guide passage communicates with the chimney passage and an electrical resistance heating element is disposed within the chimney passage in alignment with the cigarette guide passage. An actuator is movably mounted within the cigarette guide passage for energizing the resistance heating element in response to the insertion of a cigarette into the guide passage, and for de-energizing the heating element in response to the withdrawal of the cigarette from the guide passage. An updraft caused by heat generated by the resistance heating element carries smoke upwardly through the chimney, thereby providing a visual indication that the cigarette has ignited. Because of the location of the heating element within the chimney passage, tobacco particles which are dislodged when the cigarette is inserted fall downwardly through the chimney passage into the ashtray.

4 Claims, 4 Drawing Figures

ELECTRIC CIGARETTE LIGHTER

BACKGROUND OF THE INVENTION

1. Field of the Invention

The present invention relates generally to electric cigarette lighters, and in particular, to the combination of an automatic electric cigarette lighter and ashtray.

2. Description of the Prior Art

Electric cigarette lighters of the type used in automobiles are energized by either a six volt or twelve volt direct current battery as the power source. Electric cigarette lighters have not, however, been adapted for use in the home or office environment because of safety considerations. The resistance heating element typically exhibits a non-linear resistance characteristic which produces an extremely high surge current when it is initially actuated. In the automobile, the maximum amperage drawn during operation is limited to safe levels by the capacity of the battery. In the household and office, on the other hand, the maximum amount of current available is limited to a much higher, unsafe level by a circuit breaker.

OBJECTS OF THE INVENTION

It is, therefore, the principal object of the present invention to provide an automatic electric cigarette lighter which can be safely used when powered from commonly available household or office current.

Another object of the invention is to provide an electric cigarette lighter which minimizes the opportunity for shock hazard.

Another object of the invention is to provide an electric cigarette lighter having an integral lighter feature which operates automatically by manipulation of the cigarette only.

Yet another object of the invention is to provide an electric cigarette lighter which gives a visual indication that the cigarette has ignited.

Still another object of the invention is to provide an electric cigarette lighter which resists fouling of the heating element.

SUMMARY OF THE INVENTION

The foregoing objects are provided by an electric cigarette lighter having a heating element which is switched on automatically by inserting a cigarette into a guide passage. According to a preferred embodiment, the cigarette lighter is supported by a housing assembly having a lower base portion defining an ashtray and an upper housing portion supported in a position overlying the ashtray. The upper housing portion is intersected by an upwardly extending chimney passage which overlies the ashtray. A transversely extending guide passage communicates with the chimney passage. The electrical resistance heating element is lodged within the chimney passage in alignment with the cigarette guide passage. A trip switch assembly including an actuator moveably mounted within the cigarette guide passage is engagable by a cigarette as it is moved toward the resistance heating element. Movement of the actuator closes a trip switch thereby causing current to be conducted through the resistance heating element. Withdrawal of the cigarette from the passage disengages the trip switch and interrupts power to the resistance heating element.

According to this arrangement, heat radiated by the resistance element induces an updraft which carries smoke upwardly through the chimney passage, thereby providing a visual indication that ignition has occurred. Because the resistance heating element is lodged within the chimney passage, tobacco particles and combustion residue fall through the chimney passage into the underlying ashtray.

The novel features which characterize the invention are defined by the appended claims. The foregoing and other objects, advantages, and features of the invention will hereinafter appear, and for purposes of illustration of the invention, but not of limitation, an exemplary embodiment of the invention is shown in the appended drawings.

DESCRIPTION OF THE PREFERRED EMBODIMENT

Figure 1:
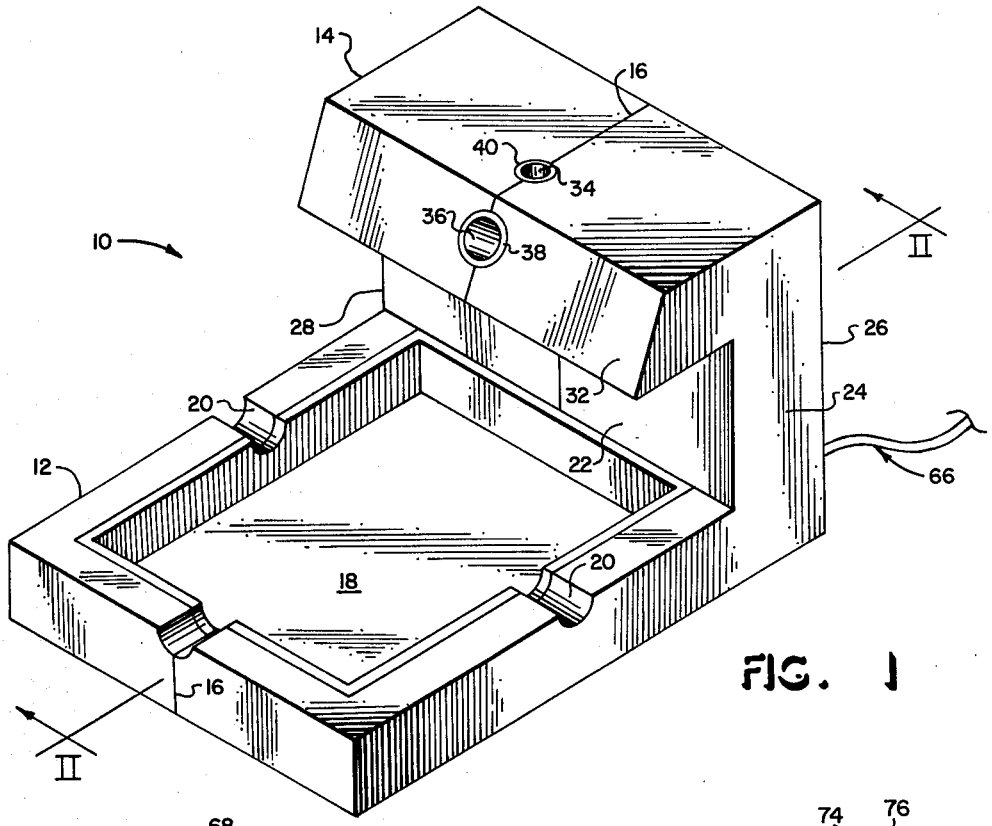
FIG. 1 is a perspective view of an electrical cigarette lighter.

In the description which follows, like parts are marked throughout the specification and drawing with the same reference numerals, respectively. The drawings are not necessarily to scale and in some instances portions have been exaggerated in order to more clearly depict certain features of the invention.

Figure 3:
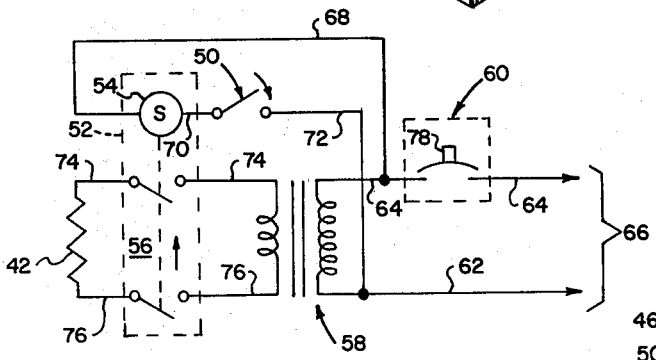
FIG. 3 is a circuit schematic diagram of the automatic cigarette lighter shown in FIG. 1; and, FIG. 4 is a detailed view, partly in section, of a resistance heating element and guide passage assembly.
Figure 2:
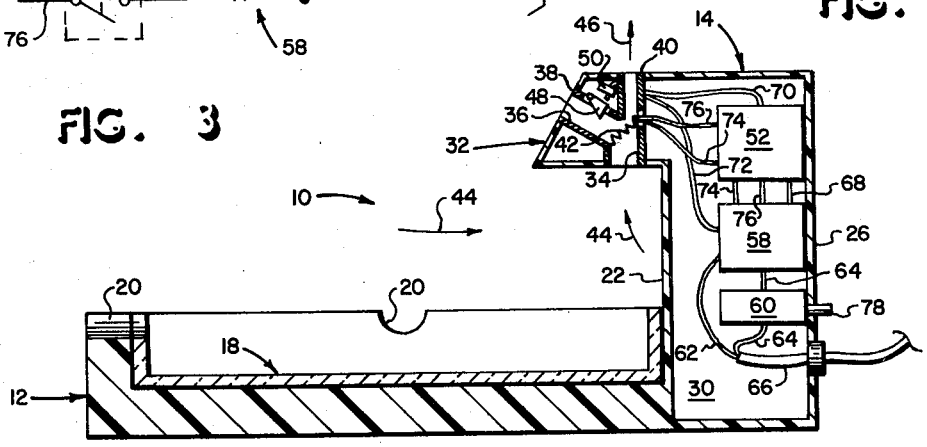
FIG. 2 is a sectional view of the automatic cigarette lighter of FIG. 1 taken along the lines II—II.

Referring now to FIG. 1, the invention is embodied in an electric cigarette lighter assembly 10 having a lower housing portion forming an ashtray base 12, and an upper housing portion 14 which encloses the automatic cigarette lighter components and circuitry as shown in FIGS. 2 and 3. The housing portions are formed of a non-conductive material such as wood or plastic. An injection moldable material such as plastic is preferred. The housing shown in FIG. 1 is partitioned along a dividing line 16, with the housing being formed in two symmetrical halves in an injection molding process.

A cavity is formed within the ashtray base 12 in which is received a glass ashtray liner 18. Notches 20 are formed in the lower ashtray base portion 12 and in the ashtray liner 18 which serve as cigarette rests.

According to an important feature of the invention, the upper housing portion 14 includes upstanding panels 22, 24, 26 and 28 which, in combination, define a component chamber 30. The upper housing portion 14 includes a cantilevered housing portion 32 which overlies the ashtray 18. The cantilevered housing portion 32 is intersected by a vertically extending chimney passage 34 and a transversely extending cigarette guide passage 36. The chimney passage 34 and the cigarette guide passage 36 are each preferably constructed of a material having a high melting point such as a metal coated by a refractory enamel, or a refractory hard metal. Other high temperature-duty materials such as ceramic or porcelain may be used to good advantage.

Figure 4:
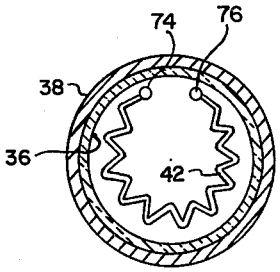

In the preferred embodiment shown in FIGS. 1, 2 and 4, the cigarette guide passage 36 is defined by a metal tube 38 the inside bore of which is coated with a refractory enamel. Likewise, the chimney 34 is defined by a metal tube 40 which is also coated by a refractory enamel.

As can best be seen in FIG. 2, the cigarette guide passage 36 extends transversely with respect to the vertically extending chimney passage 34. Moreover, the cigarette guide passage 36 is joined in communication with the chimney passage 34.

As can best be seen in FIGS. 2 and 4, an electrical resistance heating element 42 is lodged within the chimney passage 34 and is aligned with the cigarette guide passage 36. According to this arrangement, heat generated by the resistance heating element 42 induces an updraft through the chimney passage 34 as indicated by the arrows 44, which carries smoke upwardly through the chimney passage, thereby promoting rapid combustion, and providing a visual indication that combustion has occurred as smoke rises out of the chimney passage 34, as indicated by the arrow 46.

Referring to FIG. 4, the resistance heating element 42 is preferably formed in a circular, zig-zag array, with a mean diameter equal to the diameter of a cigarette. Moreover, the circular resistance heating element 42 extends transversely across the chimney passage 34, and substantially at a right angle with respect to the cigarette guide passage 36. According to this arrangement, a large portion of the distal end of a cigarette is directly engagable with the resistance heating element 42 for rapid ignition. Moreover, in this arrangement, tobacco particles and combustion residue will fall directly through the chimney passage 34 into the underlying ashtray 18.

An important object of the invention is to provide for automatic lighting of a cigarette by manipulation of the cigarette only. This is carried out as shown in FIG. 2 by the provision of an acutator 48 which is mounted on the upper housing 14 for pivotal movement into and out of the cigarette guide passage 36. Mounted in the path of movement of the actuator 48 is a micro-switch 50 which is electrically coupled to a solenoid switching assembly 52 for opening and closing a conductive path to the resistance heating element 42 in response to the insertion and withdrawal of a cigarette through the cigarette guide passage 36.

Referring now to FIGS. 2 and 3, electrical current is conducted through the resistance heating element 42 as the micro-switch 50 is closed by operation of a solenoid 54 which is mechanically coupled to a normally open, double-pole contactor 56. Thus, in the absence of a cigarette within the cigarette guide passage 36, the micro-switch 50 is open, thereby de-energizing the solenoid 54. In this condition, the contactor switch 56 is open, thereby completely disconnecting the resistance heating element 42.

Because the household voltage level is typically 110 volts peak-to-peak AC, operating current is delivered through a step-down transformer 58. In this arrangement, the secondary of the step-down transformer delivers a substantially lower peak-to-peak voltage for example 12 volts AC. As a safety feature, a resettable circuit breaker 60 is connected in series electrical relation with the primary winding of the transformer 58. The purpose of the circuit breaker 60 is to automatically disable the cigarette lighter assembly in the event of a closed circuit failure of the contactor 56. As can be seen in FIG. 3, the series connected solenoid 54 and micro-switch 50 are connected in parallel circuit relation with the primary of the step-down transformer 58. Operating power is delivered through power conductors 62, 64 of a conventional power cord 66.

Referring to FIGS. 2 and 3, the solenoid 54 is electrically connected directly to the power conductor 64 between the primary of the step-down transfor mer 58 and the circuit breaker 60 by conductor 68. One pole of the micro-switch 50 is connected to the solenoid 54 by a conductor 70. The other pole of the micro-switch 50 is connected to power conductor 62 by a conductor 72. Finally, the secondary winding of the step-down transformer 58 is connected to the solenoid assembly 52 by conductors 74, 76.

In operation, the power cord 66 is plugged into the power outlet of a home or office. The input impedance of the step-down transformer 58 is very high, whereby relatively low power is dissipated in the standby condition. Upon the insertion of a cigarette into the cigarette guide passage 36, the actuator 48 rotates upwardly into engagement with the micro-switch 50, which energizes the solenoid 54 and causes the contactor switch 56 to close. As electrical current is conducted through the resistance heating element 42, the cigarette ignites and smoke issues through the chimney passage 34 as indicated by the arrow 46. Combustion air is drawn upwardly through the chimney by the generation of heat which stimulates an updraft of combustion air through the chimney passage as indicated by the arrow 44. As soon as smoke issues from the chimney passage, the cigarette is withdrawn, thereby disengaging the micro-switch and automatically interrupting the flow of current to the resistance heating element 42. Should a power surge occur which exceeds a safe operating level, the circuit breaker 60 will automatically disengage, thereby interrupting power to the assembly. The circuit breaker 60 is preferably manually resettable and includes a reset actuator 78.

From the foregoing description of a preferred embodiment, it will be apparent that the electric cigarette lighter assembly 10 can be used safely with commonly available household current without the risk of a shock hazard or fire hazard. The cigarette lighter assembly features an integral lighter feature which operates automatically by manipulation of the cigarette only. Moreover, the chimney feature provides a visual indication that the cigarette has been ignited, thereby minimizing the duty cycle of the heating element and extending its life. Operation of the resistance heating element within the chimney passage induces an updraft of combustion air which promotes rapid ignition. Moreover, the open center, circular heating element arrangement resists fouling by combustion residue, with tobacco and other residue falling downwardly through the chimney passage into the underlying ashtray.

Although a preferred embodiment of the invention has been described in detail, it should be understood that various changes, substitutions and alterations can be made therein without departing from the spirit and scope of the invention as defined by the appended claims.

What is claimed is:

1. An electric cigarette lighter comprising, in combination:

a housing of electrically insulating material having a lower base portion defining an ashtray and an upper housing portion supported in a position overlying the ashtray, said upper housing portion having an upwardly extending passage defining a chimney overlying the ashtray, and having a transversely extending cigarette guide passage communicating with the chimney passage;

an electrical resistance heating element disposed within the chimney passage in alignment with the cigarette guide passage;

an electrical circuit connected to said heating element for conducting electrical current to said heating element from an external power source; and, switching means coupled to said circuit for opening and closing a conductive path from the external power source to said heating element.

2. The electric cigarette lighter as defined in claim 1, said switching means comprising:

an actuator disposed in the cigarette guide passage and movably coupled to said switching means for closing the electrically conductive path in response to insertion of a cigarette into the guide passage, and for opening the electrically conductive path in response to the withdrawal of the cigarette from the guide passage.

3. The electric cigarette lighter as defined in claim 1, said switching means comprising:

a normally open contactor switch connected in series circuit relation with said heating element;

a solenoid mechanically coupled to said contactor for closing said contactor switch when said solenoid is energized; and, a manually operable trip switch connected in series circuit relation with said solenoid for selectively energizing said solenoid.

4. The electric cigarette lighter as defined in claim 1, said electrical resistance heating element comprising a resistance wire having zig-zag segments arranged in a circular pattern about an open center.

* * * * *